US007730619B2

(12) United States Patent
Ozenick

(10) Patent No.: US 7,730,619 B2
(45) Date of Patent: Jun. 8, 2010

(54) ERGONOMICALLY ARCUATE MULTI-BLADE RAZOR

(76) Inventor: Debra Lynn Ozenick, 6209 Tiffany Oaks La., Arlington, TX (US) 76016

( * ) Notice: Subject to any disclaimer, the term of this patent is extended or adjusted under 35 U.S.C. 154(b) by 244 days.

(21) Appl. No.: 11/899,938

(22) Filed: Sep. 10, 2007

(65) Prior Publication Data

US 2008/0072431 A1 Mar. 27, 2008

Related U.S. Application Data

(60) Provisional application No. 60/847,259, filed on Sep. 26, 2006.

(51) Int. Cl.
*B26B 21/56* (2006.01)
*B26B 21/14* (2006.01)

(52) U.S. Cl. ..... 30/49; 30/50; D28/49

(58) Field of Classification Search ..... 30/29.5, 30/34.1, 48, 49, 50; D28/45, 46, 47
See application file for complete search history.

(56) References Cited

U.S. PATENT DOCUMENTS

| | | | | |
|---|---|---|---|---|
| 2,127,010 | A * | 8/1938 | Sampson | 30/70 |
| 4,807,360 | A * | 2/1989 | Cerier et al. | 30/49 |
| 4,964,214 | A * | 10/1990 | Welsh et al. | 30/49 |
| 5,208,982 | A | 5/1993 | Ferruzza et al. | |
| 5,542,178 | A * | 8/1996 | Harkleroad | 30/34.1 |
| 5,568,688 | A * | 10/1996 | Andrews | 30/29.5 |
| 5,761,812 | A * | 6/1998 | Feldman | 30/34.1 |
| 5,979,056 | A * | 11/1999 | Andrews | 30/49 |
| 6,212,777 | B1 | 4/2001 | Gilder et al. | |
| 7,200,938 | B2 * | 4/2007 | Lembke | 30/50 |
| 2004/0255467 | A1 * | 12/2004 | Lembke et al. | 30/50 |
| 2005/0172494 | A1 * | 8/2005 | Aviza et al. | 30/50 |
| 2006/0112564 | A1 * | 6/2006 | Coffin | 30/50 |

FOREIGN PATENT DOCUMENTS

GB 2 276 842 A * 10/1994

* cited by examiner

*Primary Examiner*—Hwei-Siu C Payer

(57) ABSTRACT

A shaving device assembled with multiple blades having a generally planar portion and arcuate end portions in a generally parallel spaced relationship adapted for shaving curvilinear areas of a body.

20 Claims, 3 Drawing Sheets

ERGONOMICALLY ARCUATE MULTI-BLADE RAZOR

CROSS REFERENCE TO RELATED APPLICATION

This application claims the benefit of U.S. Provisional Application No. 60/847,259 filed on Sep. 26, 2006, entitled "ERGONOMICALLY ARCUATE MULTI-BLADE RAZOR."

FIELD OF THE INVENTION

The present invention relates to razor assemblies and, more particularly, but not by way of limitation, to an ergonomic multi-blade razor having multiple blades each with a planar portion and arcuate end portions for shaving areas of a body with improved comfort and efficiency.

BACKGROUND

Razors have been used for centuries to facilitate the grooming of a body as well as other uses. However, grooming of the human body has been the dominant commercial area for decades. Technologically, razor designs have thus advanced dramatically as demand has grown within the last century. Razors have progressed in design from a single, linear sharpened blade to specially mounted multiple, linear blade assemblies facilitating the shaving of the face and other generally planar areas of the human body. The advantages of multi-blade assemblies are well known. Typically, multi-blade razor structures include a plastic housing that supports the multiple linear blades in a staggered, generally parallel relationship, whereby the skin surface shaved by the passage of the first blade is additionally shaved by the passage of the second and/or multiple other blades resulting in a more efficient shaving process. One of the key aspects in multiple blade assemblies is the mounting configuration and the safety aspect for protecting the skin of the user from nicks, scrapes, and scratches by exposing only the portion of the linear blade necessary for grooming.

Other improvements in razor blade designs have included means for mounting single razor blades in a housing imparting a bending to the blade to thereby facilitate the presentation of an arcuate single blade within a safety blade housing for shaving sloped areas of the human body, such as under arm and groin regions which are typically non-planar in formation as seen in U.S. Pat. No. 5,208,982 to Ferruzza. The advantage of such an arcuate assembly is readily apparent by virtue of the fact that some areas of the human anatomy are not substantially planar and are often considered required grooming areas. These areas are typically sensitive to sharp razor blade exposure. Therefore, any improvement in razor designs that may eliminate the danger of cuts and/or nicks from the shaving procedure and/or improving the efficiency of the shaving procedure in such delicate areas of a body, would be a marked advantage. Further other improvements in razor design include safety razor blade units including a plurality of blades with parallel sharpened edges as seen in U.S. Pat. No. 6,212,777 to Gilder et al.

SUMMARY OF THE INVENTION

The present invention relates to improvements in shaving technology. More particularly, one aspect of the invention incorporates a shaving device assembled with multiple blades having a planar portion and arcuate end portions in a generally parallel spaced relationship adapted for shaving curvilinear areas of a body. To those skilled in the art to which this invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

The present invention is directed to a safety razor, having a razor head having a planar intermediate portion extending in a longitudinal direction along a generally horizontal plane and two generally arcuate end portions, each extending outwardly and downwardly from a respective end of the planar intermediate portion so that the planar intermediate portion and the arcuate end portions form a substantially inverted "U" shape with a planar portion between the arcuate end portions, and adapted to position blade alignment guides at predetermined intervals to locate a plurality of blades in a desirable configuration. The blade alignment guides formed in the razor head and following the shape of the substantially inverted "U" for receiving and positioning of a plurality of substantially parallel blades for supporting same relative to an arcuate disposition thereof; and a plurality of substantially parallel blades positioned within said blade alignment guides and following the shape of the substantially inverted "U", each blade having a cutting edge and an intermediate, generally linear, planar portion and two, oppositely disposed, generally arcuate end portions, the cutting edge protruding outwardly from the blade alignment guides and following the shape of the substantially inverted "U" on the arcuate portions having a positive curvature extending from said generally linear portion.

DESCRIPTION OF THE DRAWINGS

A more complete understanding of the present invention may be obtained by reference to the following Detailed Description, when taken in conjunction with the accompanying Drawings, wherein.

DETAILED DESCRIPTION

The present invention will now be described more fully with reference to the accompanying drawings, in which a preferred embodiment of the invention is shown. This invention may, however, be embodied in many different forms and should not be constructed as limited to the embodiments set forth herein; rather, these embodiments are provided so that this disclosure will be thorough and complete, and will fully convey the scope of the invention to those skilled in the art.

Figure 1:
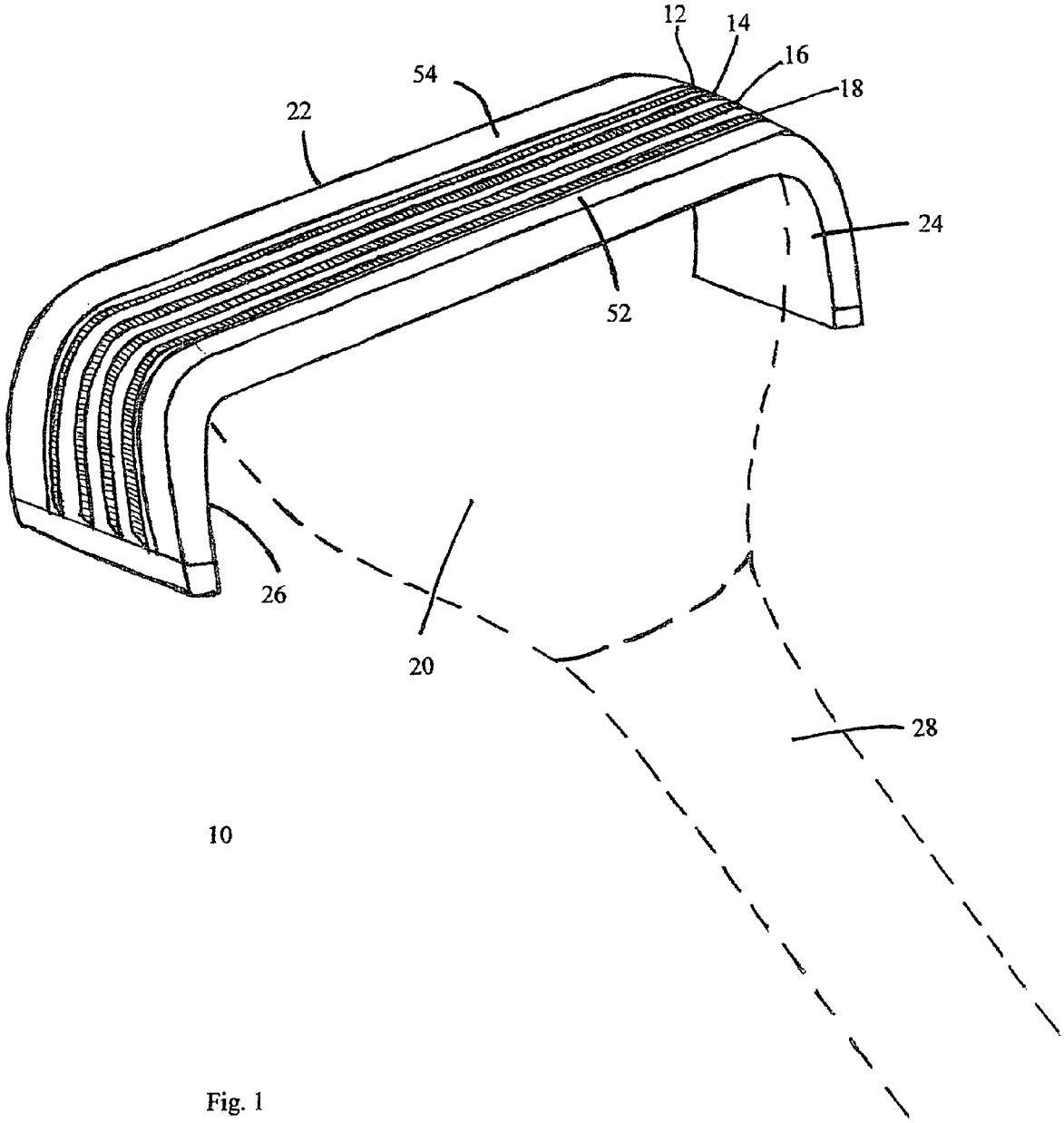
FIG. 1 is a front perspective view of an embodiment of the present invention.

Referring now to FIG. 1, there is shown a safety razor 10 constructed in accordance with the principles of the present invention. The safety razor 10 comprises a razor head 20 disposed at the end of a handle 28, said razor head 20 having a plurality of blades 12, 14, 16, and 18 disposed in a generally parallel spaced relationship. The razor head 20 has a generally planar intermediate portion 22 and two arcuate end portions 24 and 26. More specifically, the arcuate portions 24 and 26 define a positive (with reference to the exposed edges of the blades) curvature of the plurality of blades 12, 14, 16 and 18, wherein curvature is the ratio of the change in the angle of a tangent that moves over a given arc to the length of the arc. A positive curvature is generally associated with a convex shape and a negative curvature is associated with a concave shape. Viewing safety razor 20 in two dimensions with intermediate portion 22 lying along the abscissa of a Cartesian coordinate system, the positive curvature of arcuate portions 24 and 26 can be seen in FIG. 1. The intermediate portion 22 and arcuate portions 24 and 26 are adapted to position blades 12, 14, 16, and 18 with respect to each other and are more clearly illustrated in FIG. 3 discussed herein below.

In an embodiment of the present invention, razor head 20 is permanently attached to a handle 28. Said razor head 20 can be in a fixed position on the handle 28 or pivotable about an axis parallel to the blade edges. In a further embodiment of the present invention, razor head 20 is in the form of a detachable cartridge without a housing, but only blade alignment guides, said cartridge intended to be replaced when the blade edges have become dulled. In said further embodiment, detachable razor head 20 can be in a fixed position on the handle 28 or can be pivotable about an axis parallel to the blade edges.

Safety razor 10 includes several varying designs. It can be designed as a single piece disposable razor having a hollow plastic handle 28 with razor head 20 holding blades 12, 14, 16 and 18. As noted above, safety razor 10 can also be designed to accept refillable cartridges holding blades 12, 14, 16 and 18. This latter design, in which the razor handle is not disposable, but the cartridge is disposable, can include other premium features such as a soft grip handle and a moisturizer container disposed to dispense moisturizer through the handle to an area proximate the blades 12, 14, 16 and 18.

Razor blades 12, 14, 16 and 18 are typically made of a corrosion resistant steel alloy which is hard enough to allow each blade to hold its shape, yet malleable enough to allow it to be formed into its arcuate positions. Preferably, said steel alloy is a carbide steel made with a tungsten-carbon compound. Said compound may include primarily iron with a combination of carbon, silicon, manganese, chromium and molybdenum.

The plastic portions of safety razor 10 are typically molded from a number of different plastic resins including polystyrene, polypropylene, and phenyleneoxide based resins as well as elastomeric compounds. These resins begin in pellet form and are melted and molded using extrusion and injection molding techniques. Safety razor 10 further includes components that hold the blades in place and springs or other release mechanisms which facilitate changing of blade cartridges.

The manufacture of blades 12, 14, 16 and 18 requires the mixing and melting of the above referenced steel alloy material. The mixture first undergoes an annealing process wherein the steel alloy is heated to a temperature of about 2,000° F., then quenched in water to a temperature of about 100° F. to harden it. The steel is then tempered at a temperature of between 500 and 750° F. Blades 12, 14, 16 and 18 are then die stamped to form a planar shape and bent using a metal bending tool to form their respective arcuate shape. The cutting surface of intermediate portion 22 of each blade is about 2 to 4 centimeters by 0.75 to 3 millimeters. The arcuate cutting surfaces of end portions 24 and 26 of each blade (beginning at the point where the curvature of the arcuate portions begin) are in the range of 0.75 to 1.5 centimeters by 0.75 to 3 millimeters. Further, the distance from the edge of each blade to the edge of its adjacent blade is in the range of 0.5 to 1.75 mm.

Figure 2:
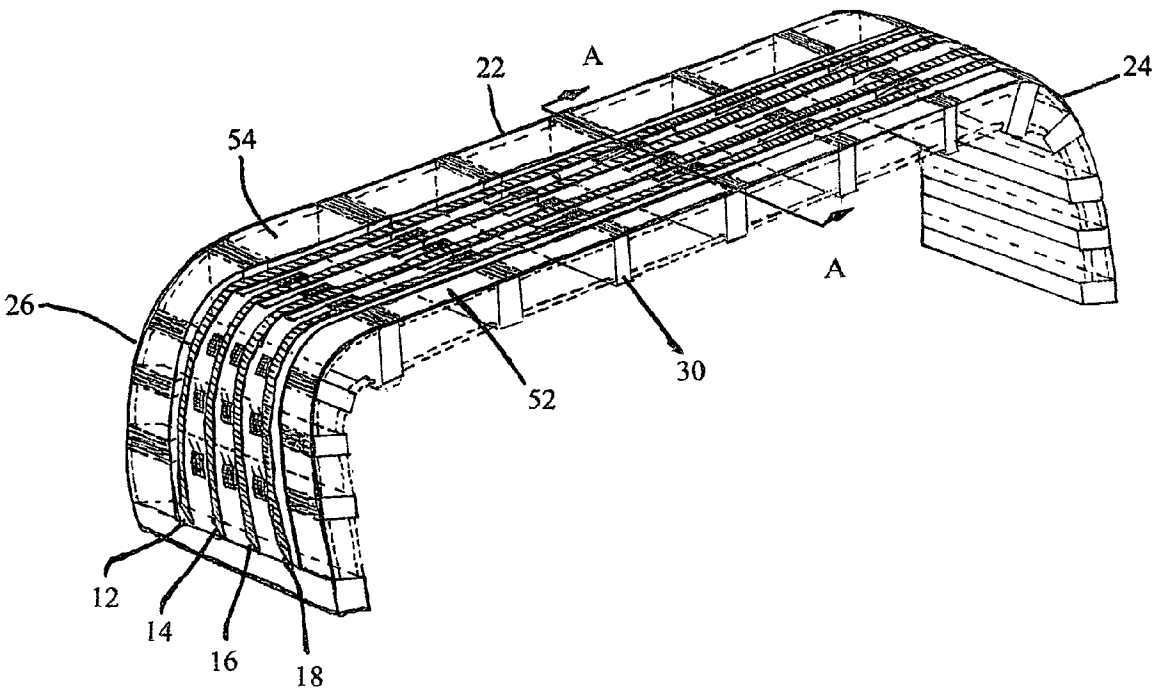
FIG. 2 is a perspective view of the razor head of FIG. 1 illustrating various constructional aspects thereof in accordance with the principles of the present invention.

Referring now to FIG. 2, intermediate portion 22 and arcuate portions 24 and 26 are shown in more detail. A series of blade alignment guides 30 are shown placed at predetermined intervals along intermediate portion 22 and arcuate portions 24 and 26 for receipt and positioning of razor blades 12, 14, 16, and 18 is in a generally parallel spaced relationship. Each blade alignment guide is held in place by the structure formed by the intermediate portion 22 and the arcuate portions 24 and 26.

Figure 3:
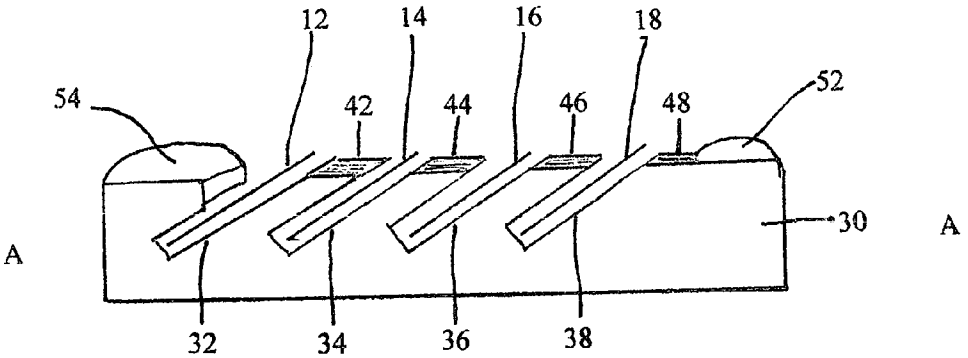
FIG. 3 is an enlarged side elevation view of the shaver head of FIG. 1 illustrating additional construction on features thereof.

Referring now to FIG. 3, razor alignment guide 30 is shown with angled slots 32, 34, 36, and 38 adapted for the receipt and positioning of razor blades 12, 14, 16, and 18. The angled slots 32, 34, 36, and 38 are formed at a predetermined angle in accordance with the principles of the design. For example, assume solely for purposes of illustration that intermediate portion 22 of each blade 12, 14, 16 and 18 have the same three dimensional sizes of 3.5 cm by 0.1 mm by 1 mm. Further assume that a corner of blade 12 is placed at the origin 0, 0, 0. With the forgoing length x, height y, and width z, it would extend from the origin to x, y, z coordinates of 3.5 cm, 0.1 mm, −1 mm (e.g., the front cutting edge of blade 12 is lying flat on the x-axis). Then the extent of intermediate portion 22 of blade 14 would be located at, e.g., 3.5 cm, 0.10 mm, −5 mm; the extent of intermediate portion 22 of blade 16 would be located at, e.g., 3.5 cm, 0.20 mm, −10 mm; and the extent of intermediate portion 22 of blade 18 would be located at, e.g., 3.5 cm, 0.30 mm, −15 mm. The arcuate portions of each of the blades would be similarly spaced from the adjacent blades.

Positioned between slots 32, 34, and 36 and after slot 38 are decks 42, 44, 46, and 48 respectively. Decks 42, 44, 46, and 48 are adapted to reduce the instances where a user might cut his or her skin with blades 12, 14, 16, and 18. A leading comfort pad 52 and a trailing comfort pad 54 further help reduce the instances a user might cut his or her skin with blades 12, 14, 16, and 18. Said comfort pads can include lubricating strips and water activated moisturizers.

Figure 4:
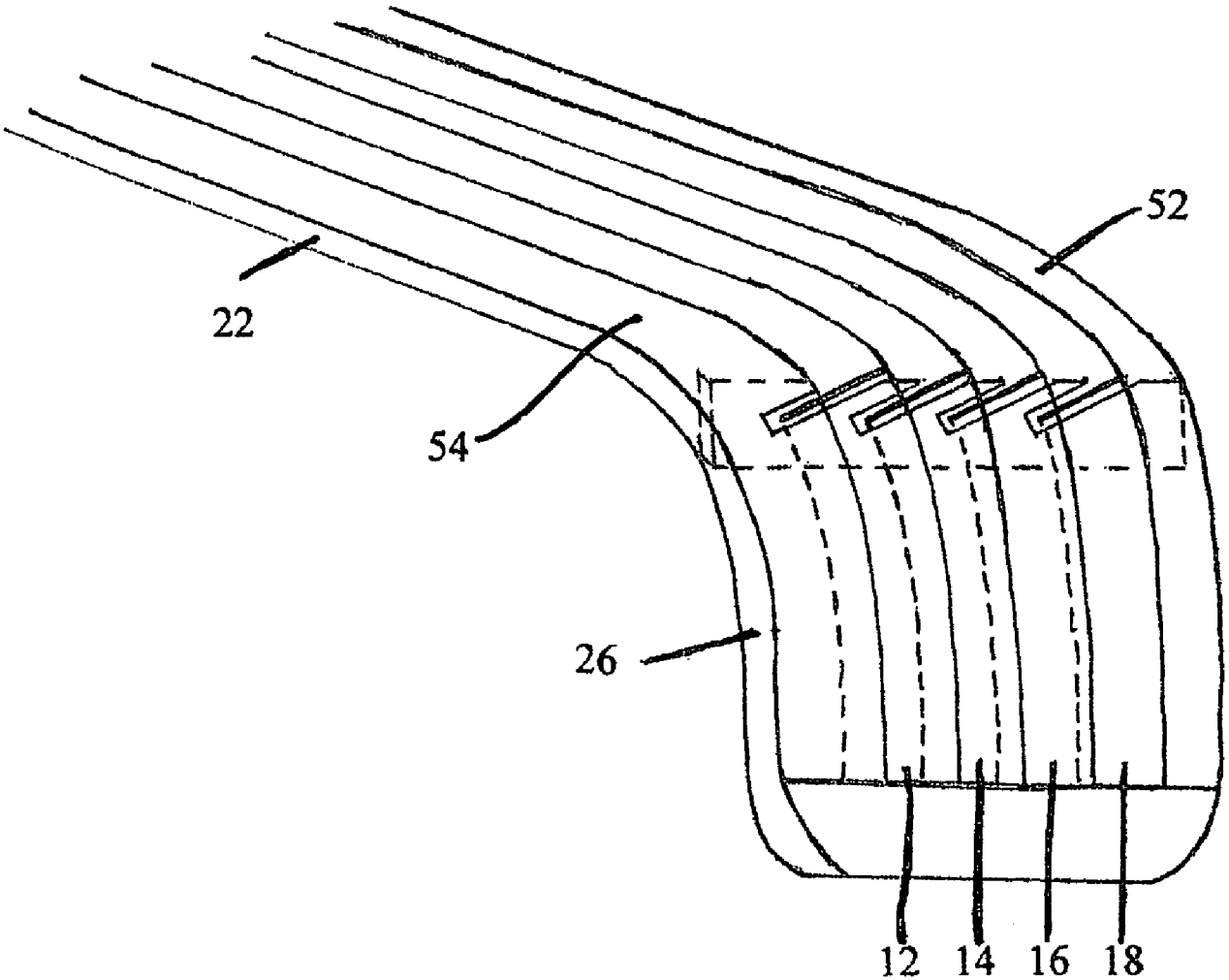
FIG. 4 is an enlarged, fragmentary perspective view of an end region of the shaver head of FIG. 1 illustrating other constructional aspects thereof in accordance with the principles of the present invention.

FIG. 4 depicts another embodiment of the present invention wherein the intermediate portion 22 and the end portions 24 and 26 (only 26 is shown) of the razor have a higher degree of curvature.

The embodiments shown and described above are only exemplary. Even though numerous characteristics and advantages of the preferred embodiment of the present invention have been set forth in the foregoing description together with details of the invention, the disclosure is illustrative only and changes may be made within the principles of the invention to the full extent indicated by the broad general meaning of the terms used in the attached claims.

I claim:

1. A safety razor, comprising:

a razor head having a planar intermediate portion extending in a longitudinal direction along a generally horizontal plane and two generally arcuate end portions, each extending outwardly and downwardly from a respective end of the planar intermediate portion so that the planar intermediate portion and the arcuate end portions form a substantially inverted "U" shape with the planar intermediate portion between the arcuate end portions and adapted to position blade alignment guides at predetermined intervals to locate a plurality of blades in a desirable configuration;

blade alignment guides formed in the razor head and spaced apart from each other in a direction following the shape of the substantially inverted "U" for receiving and positioning of a plurality of substantially parallel blades for supporting same relative to an arcuate disposition thereof; and a plurality of substantially parallel blades positioned within said blade alignment guides and following the shape of the substantially inverted "U", each blade having a cutting edge and an intermediate, generally linear, planar portion and two, oppositely disposed, generally arcuate end portions, the cutting edge protruding outwardly from the blade alignment guides and following the shape of the substantially inverted "U" said cutting edge on the arcuate portions of the blade having a positive curvature extending from said generally linear portion.

2. The safety razor of claim 1, having two substantially parallel blades.

3. The safety razor of claim 1, having three substantially parallel blades.

4. The safety razor of claim 1, having four substantially parallel blades.

5. The safety razor of claim 1, in combination with a razor handle.

6. The combination of claim 5, wherein said razor handle is made of a plastic, disposable material.

7. The combination of claim 5, wherein said razor head is in a fixed position on the handle.

8. The combination of claim 5, wherein said razor head is pivotable about an axis parallel to the cutting edges of the plurality of blades.

9. The safety razor of claim 1, wherein said razor head is in the form of a detachable cartridge intended to be replaced when the cutting edges have become dulled.

10. The safety razor of claim 9, in combination with a razor handle.

11. The combination of claim 10, wherein said razor head is in a fixed position on the razor handle.

12. The combination of claim 10, wherein said razor head is pivotable about an axis parallel to the cutting edges.

13. The safety razor of claim 1, further including a lubricating strip along the front edge and the back edge of the razor head.

14. The safety razor of claim 1 wherein each blade is angled at a same angle as its adjacent blade.

15. A safety razor, comprising:

a plurality of substantially parallel blades each having a cutting edge and an planar intermediate, generally linear portion extending in a longitudinal direction along a generally horizontal plane and two, oppositely disposed, generally curved end portions each extending outwardly and downwardly from a respective end of the planar intermediate generally linear portion so that the planar intermediate generally linear portion and the generally curved end portions form a substantially inverted "U" shape with the planar portion between the generally curved end portions;

blade alignment guides formed in a razor head and following the shape of the substantially inverted "U" for receiving and positioning of said plurality of substantially parallel blades for supporting same relative to an angled disposition thereof; one related to another in generally parallel spaced relationship;

a razor head having a planar intermediate portion extending in a longitudinal direction along a generally horizontal plane and two generally curved end portions each extending outwardly and spaced apart from each other in a direction downwardly from a respective end of the planar intermediate portion of the razor head so that the planar intermediate portion of the razor head and the generally curved end portions of the razor head form a substantially inverted "U" shape with the planar portion of the razor head between the generally curved end portions of the razor head and adapted to position said blade alignment guides at predetermined intervals to locate said plurality of blades in a desirable configuration; and a razor handle coupled to, and extending orthogonally from, the approximate longitudinal center of the razor head opposite the cutting edge of the blades.

16. The safety razor of claim 15, having two substantially parallel blades.

17. The safety razor of claim 15, having three substantially parallel blades.

18. The safety razor of claim 15, having four substantially parallel blades.

19. The safety razor of claim 15, wherein said razor head is in a fixed position with respect to the razor handle.

20. The safety razor of claim 15, wherein said razor head is in a pivotable position with respect to the razor handle.

* * * * *